US005783000A

United States Patent [19]

Axelsson et al.

[11] Patent Number: 5,783,000

[45] Date of Patent: Jul. 21, 1998

[54] METHOD FOR HEAT TREATMENT OF STEEL, AND PRODUCTS OF STEEL

[75] Inventors: Carl-Lennart Axelsson, Skarpnäck; Sten Ljungars, Torshälla; Lars Folke Saltin, Västerås; Sven-Eric Lunner, Täby; Sten-Åke Brännvall, Kristinehamn, all of Sweden

[73] Assignees: AGA Aktiebolag, Lidingo; Avesta Sheffield Aktiebolag, Avesta, both of Sweden

[21] Appl. No.: 700,438

[22] PCT Filed: Mar. 7, 1995

[86] PCT No.: PCT/SE95/00243

§ 371 Date: Sep. 6, 1996

§ 102(e) Date: Sep. 6, 1996

[87] PCT Pub. No.: WO95/24509

PCT Pub. Date: Sep. 14, 1995

[30] Foreign Application Priority Data

Mar. 9, 1994 [SE] Sweden ..... 9400807

[51] Int. Cl.[6] ..... C21D 9/08; C21D 6/00

[52] U.S. Cl. ..... 148/605; 148/606; 148/591; 148/592

[58] Field of Search ..... 148/605, 591, 148/633, 606, 590, 592

[56] References Cited

U.S. PATENT DOCUMENTS

| | | | |
|---|---|---|---|
| 1,815,505 | 7/1931 | Guthrie et al. . | |
| 4,397,451 | 8/1983 | Kinoshita et al. | 266/252 |
| 4,713,154 | 12/1987 | Ohta et al. | 148/606 |

FOREIGN PATENT DOCUMENTS

| | | |
|---|---|---|
| 0038257 | 10/1981 | European Pat. Off. . |
| 0506043 | 9/1992 | European Pat. Off. . |

*Primary Examiner*—Deborah Yee
*Attorney, Agent, or Firm*—Alfred J. Mangels

[57] ABSTRACT

A method for heat-treating steel, primarily strip-like or rod-like steel material, such as steel strip, steel sheet, steel rod or steel wire which have been rolled and heated in an oven or furnace to a surface temperature above about 900 degrees C. and thereafter cooled and optionally treated in an electrolyte bath and/or acid bath. The oven burners are fired with a liquid or a gaseous fuel which is burned with the aid of a gas that contains at least 85 percent by volume oxygen and at most 10 percent by volume nitrogen.

15 Claims, 1 Drawing Sheet

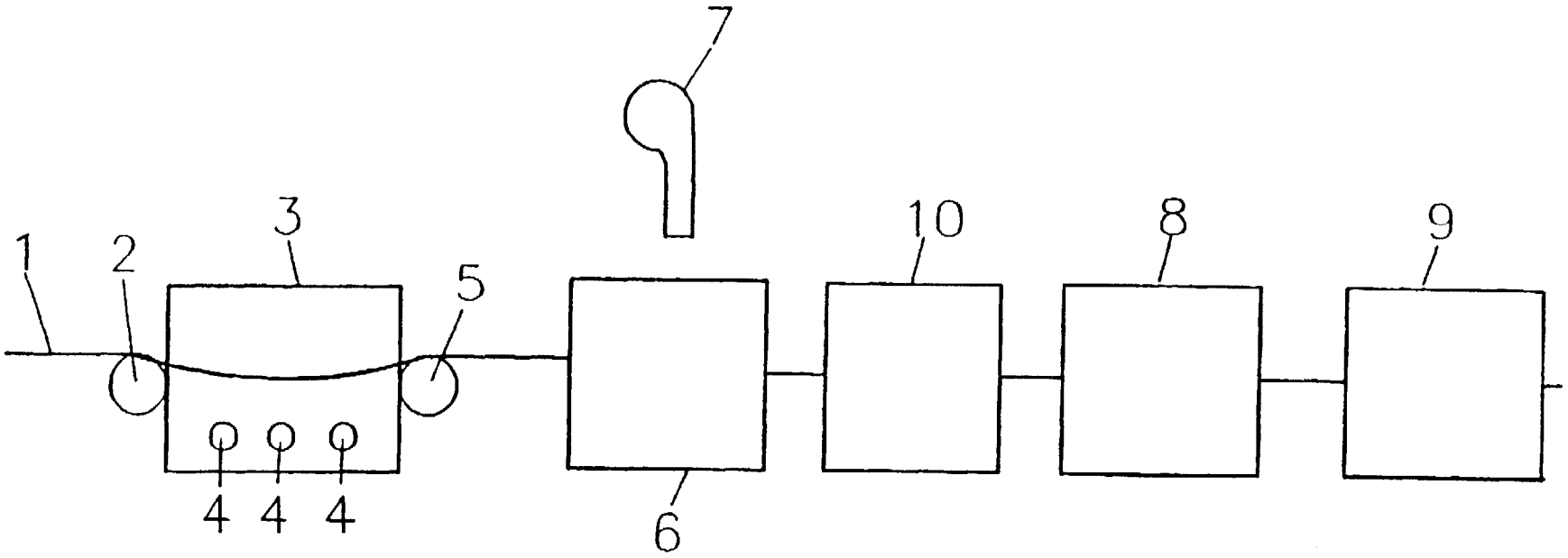
1
2
3
4
4
4
5
7
6
10
8
9

METHOD FOR HEAT TREATMENT OF STEEL, AND PRODUCTS OF STEEL

BACKGROUND OF THE INVENTION

1. Field of the Invention

The present invention relates to a method of heat treating steel pipes, steel tubes, and cold-rolled or hot-rolled steel band-like or rod-like material, such as steel bands, steel strip, steel sheets, steel rods or steel wire which are subsequently heated for soft-annealing purposes.

The invention also relates to steel products that have been treated by means of the inventive method.

2. Description of the Related Art

With the intention of improving the ductility of rod-like or flat, cold- rolled or hot-rolled band-like steel products, the products are heated in an oven to a surface temperature of about 900 degrees C. or higher, normally to a temperature of about 1100 degrees C., and in some cases up to 1300 degrees C. The products are then cooled, normally in air. After cooling the products, it is necessary to remove the oxidation products that form on the surfaces of the cooled products. This is effected in different types of baths, normally an electrolyte bath and/or oxygen bath.

The products are advanced continuously and in succession through the heating oven or furnace, said products being introduced at one end of the oven or furnace and discharged at the other end thereof. The oven is heated with a liquid or gaseous fuel, which is burned with the aid of air. The products may also be heated in batches.

One process stage which determines the speed at which the method can be performed is often the treatment of the heated products in an electrolyte bath and/or an acid bath, i.e. pickling of the products.

Heating of the products in the heating oven also determines the rate at which the method can be performed.

These two rate determining stages of the method greatly limit the capacity of known production plants for the heat treatment of steel products.

Furthermore, the aforesaid baths must be handled in an environmentally friendly manner, resulting in large costs.

Another problem is that fuel combustion in the oven results in large emissions of nitrogen oxides. Large quantities of nitrogen oxides are also emitted to the ambient air when pickling the products. Pickling also results in large quantities of sludge and slime, which must be dumped.

SUMMARY OF THE INVENTION

The present invention solves the aforesaid problems. The invention enables the capacity of a given heat-treatment oven or furnace to be increased. The invention also enables treatment of products in said baths to be markedly reduced, and in certain cases omitted, therewith reducing both the emissions of nitrogen oxides and the production of sludge. The emission of nitrogen oxides from the combustion process is also reduced.

The present invention thus relates to a method of heat-treating steel objects, primarily pipes, tubes, strip, rod and wire-like steel material, such as steel band, strip, sheet, rod or wire of steel which have been rolled and heated in a furnace to a surface temperature above about 900 degrees C. and thereafter cooled and possibly treated in an electrolyte bath and/or acid bath, and includes firing the burners present in the oven with a liquid or a gaseous fuel which is caused to burn with the aid of a gas that contains at least 85 percent by volume oxygen and at most 10 percent by volume nitrogen.

The invention also relates to steel products primarily pipes, tubes, strip-like or rod-like materials made of steel, such as steel strip, steel sheet, steel rod or steel wire, which have been rolled and heated in an oven to a surface temperature above about 900 degrees C. and thereafter cooled and optionally treated in an electrolyte bath and/or acid bath, wherein the product has been heat-treated in the oven while firing the oven burners with a liquid or a gaseous fuel which has been burned with the aid of a gas that contains at least 85 percent by volume oxygen and at most 10 percent by volume nitrogen.

BRIEF DESCRIPTION OF THE DRAWINGS

The invention will now be described in more detail with reference to an exemplifying embodiment of the inventive method and also with reference to the accompanying schematic drawing, the single FIGURE of which is a schematic illustration of heat-treatment equipment and downstream pickling equipment.

DESCRIPTION OF THE PREFERRED EMBODIMENT

The drawing illustrates schematically a heat treatment and pickling process line. In the illustrated case, the product is assumed to have the form of strip, although it may have a different form as mentioned above.

Although the invention is exemplified below with reference to a method in which an elongated product is advanced through an oven or furnace, it will be understood that the invention can also be applied in the batch-wise heating of products in an oven or furnace, i.e. in which products are introduced into an oven and removed therefrom after a given predetermined time period has lapsed.

The invention can also be applied in conjunction with closed ovens, such as bright-annealing ovens. It appears that the favorable effect of short duration pickling cannot be achieved by making conventional ovens more impervious or tighter, but that it is necessary to apply the present invention with essentially oxygen gas as an oxidant in order to achieve said effect.

In the drawing FIGURE, strip 1 is taken from a reel (not shown) and passed into a heat-treatment oven or furnace 3 over a roller 2. The strip runs through the upper part of the oven. Mounted on two parallel vertical side walls of the oven 3 are a number of burners 4. The illustrated embodiment has three burners, although it will be understood that a larger number of burners may be used. The burners are fired with a liquid or gaseous fuel and an oxygen-containing gas.

The length of the oven space 3 and the speed of the strip is adapted so that the strip will be heated to the intended, predetermined temperature before leaving the oven. The strip exiting from the oven passes over a roller 5. The strip is then passed through a cooling chamber 6 into which cooling air is blown by a fan 7. The strip may then be passed through a water-cooled cooling chamber 10. When leaving the last-mentioned cooling chamber 10, the strip will have a temperature of about 70 degrees C. After leaving the cooling chamber 10, the strip is advanced to and through at least one electrolyte bath 8 and/or acid bath 9.

The invention relates to a method of heat-treating steel in such a furnace to a surface temperature of about 900 degrees C. The thus heated material is cooled in said cooling chamber, suitably to a temperature of about 70–500 degrees C., depending on the nature of the pickling process applied.

The material is thereafter optionally treated in said electrolyte bath and/or acid bath.

According to the invention, the oven burners are fired with a liquid or a gaseous fuel, which is burned with the aid of a gas that contains at least 85 percent by volume oxygen and at most 10 percent by volume nitrogen.

The invention is intended primarily for application with stainless steel. Examples of such steel are ASTM 304, ASTM 316LN, ASTM S31254 and ASTM S30815. It will be understood, however, that the invention can also be applied with other types of steel that are usually soft-annealed after being cold or hot rolled.

According to one preferred embodiment of the invention, the fuel is burned with a gas that contains at least 90 percent by volume oxygen-gas, preferably 99.5 percent by volume oxygen gas.

According to a further preferred embodiment, the gas also contains one or more noble gases in addition to oxygen-gas and nitrogen-gas.

When a fuel is burned with a gas that consists essentially in oxygen gas, mainly only water and carbon dioxide are formed. The fuel may contain impurities, such as nitrogen for instance, which form a constituent of the oven atmosphere. The oven atmosphere may also contain nitrogen and oxygen from air that leaks into the oven. The oven atmosphere may also contain oxygen generated when a surplus of oxidant is supplied to the burners.

The gases generated by the inventive combustion process contain mainly water and carbon dioxide. This combustion generated gas, or flue gas, transfers much more heat to the material by radiation than gas that has been generated by burning fuel with air as an oxidant. Radiation heat transfer is the dominant heat transfer in a process of the present kind.

This elevated heat transmission markedly reduces the time taken to heat the material in the oven, therewith enabling the material to be passed through the oven at a speed which is far greater than would otherwise be the case in respect of a given oven construction.

It has also been found surprisingly that the scale formed on the surfaces of the material as the material is heated is thinner and more easily pickled, due to the fact that the structure of the scale is different to that which forms when the material is heated in an oven in which a conventional air-based flue gas is generated. The thinner scale enables pickling times to be reduced, i.e. the length of time which the material needs to be kept in a subsequent acid bath and/or electrolyte bath. This means that for a given plant having a pickling bath of given length, the speed at which the material is passed through the pickling bath can also be increased.

The reason for the unexpected effect in the form of a thin layer of scale is thought to be because the prevailing oven atmosphere produces a thin and dense oxide layer which prevents further oxidation of the iron. It is believed that this dense oxide layer is due to the substantially enhanced heat transmission that is achieved when practicing the invention.

In some instances, the scale is so thin as to render subsequent pickling of the material unnecessary.

In summary, the capacity of a given plant can be greatly increased by applying the invention, as illustrated by the examples given below.

By using a fuel combustion gas which contains at most 10 percent by volume nitrogen, and down to below 1 percent by volume nitrogen, the emissions of oxides of nitrogen are also greatly reduced.

Although pickling can be avoided in certain cases, it is usual to subject the material to a subsequent pickling process.

According to one preferred embodiment of the invention, the material is therefore treated in an electrolyte bath and/or an acid bath, after having heated the material in the oven and then cooling the material to a temperature below about 70 degrees C.

Thus, as a result of the present invention, the material is not only heated more rapidly in the oven, but that the prevailing oven atmosphere has a greater effect on the pickling process as a result of the thinner scale formed on the material surfaces. This is a markedly important technical effect.

Because the pickling time per quantity of material is reduced in the pickling bath, the emission of nitrogen oxides from the bath will also be lower. Furthermore, less acid is required to pickle a given quantity of material.

It will therefore be obvious that the invention solves the problems mentioned in the introduction and enables the capacity of an existing plant to be greatly increased. The oven and the pickling bath may be made shorter in new plant constructions.

According to one preferred embodiment of the invention, the fuel is essentially propane. When propane is burned with a gas that contains 99.5 percent by volume oxygen, there is obtained an oven atmosphere which consists in approximately 40 percent by volume carbon dioxide, 50 percent by volume water and 10 percent by volume nitrogen and oxygen.

The material is heated in the oven for a period of 0.1 to 300 minutes, depending on whether the material has thin dimensions and is passed quickly through the oven, or whether the heating process is concerned with large material quantities that are held static in the oven during said process.

After being heated in the oven, the material is cooled to a temperature of below about 70–500 degrees C., the temperature chosen depending on the nature of the pickling process.

According to one preferred embodiment of the invention, the oven-heated material is cooled in an atmosphere which contains nitrogen, argon or hydrogen and/or mixtures thereof. This cooling process is carried out in the cooling chamber 6.

As before mentioned, the invention also relates to products that have been treated in accordance with the inventive method, wherein said products have been heated in said oven while operating the oven burners with a liquid or gaseous fuel that has been burned with the aid of a gas containing at least 85 percent by volume oxygen and at most 10 percent by volume nitrogen.

The further preferred methods described above are, of course, also preferred for treating the products.

According to one preferred embodiment, the concerned product is a high-alloy steel, such as steel containing 17% chromium and 12% nickel with at least 3 percent by weight molybdenum and where the surface chromium content is at least 97% of the average chromium content of the material.

There now follows an example performed in accordance with a known technique and compared with an example in which the present invention was applied.

Stainless steel strip is normally annealed in a stainless strip-annealing oven to a temperature of 1000–1100 degrees C. The oven may have a length of 20 meters, a height of 2 meters and a width of 2 meters.

In the ease of the known technique, a bottled gas (propane)—air mixture is burned in conventional burners. The flue gas or oven gas thus generated contains roughly 9 percent by volume $CO_2$, 12 percent by volume $H_2O$, 77 percent by volume $N_2$ and 2 percent by volume $O_2$. The cold-rolled strips are annealed to re-crystallize and obtain a suitable material structure. After the annealing process, the strip is cooled with air to temperatures below 100 degrees C., whereafter the strip is pickled in an acid bath to remove scale and to impart suitable properties to the strip surfaces. In the comparison test, the strip compressed the material ASTM 304 and had a width of 1400 millimeters and a thickness of 1.9 millimeters. The strip was transported at a maximum strip speed resulting in a clean pickled strip.

In the case of the inventive method, the air-bottled gas burners were replaced with oxygen/bottled gas burners. In this case, the burners were supplied with a bottled-gas/oxygen-gas mixture, wherein the gas used to burn the bottled gas contained 99.5 percent by volume oxygen. This resulted in a flue gas that comprised of 39 percent by volume $CO_2$, 51 percent by volume $H_2O$, 6 percent by volume $N_2$ and 4 percent by volume $O_2$. The nitrogen present in the flue gas derived from air that leaked into the oven. The strip and the oven were maintained at the same temperatures as those maintained when practicing the known technique. Strip having the same composition and the same dimensions as the earlier mentioned strip was annealed and pickled in the same oven and through the same pickling distance as in the above described example.

When practicing the invention, it was possible to reduce the pickling time by a factor of 150% up to 300% in comparison with the pickling time required when practicing the known technique, i.e. in accordance with the above example. This also enabled the strip speed to be increased to a corresponding extent.

It will thus be evident from the aforegoing that the present invention represents an essential improvement over the known technique.

Although the invention has been described above with reference to a number of exemplifying embodiments thereof, it will be understood that the invention is not limited thereto. For instance, a different type of oven or furnace may be used. Furthermore, the cooling devices and the pickling section comprising said acid and/or electrolyte bath can be constructed in other ways without departing from the inventive concept.

The present invention shall therefore not be considered restricted to the aforedescribed exemplifying embodiments thereof, since modifications and variations can be made within the scope of the following claims.

What is claimed is:

1. A method for heat-treating stainless steel articles, said method comprising heating the articles in a heat treatment oven to a surface temperature above about 900 degrees C., wherein the heat treatment oven includes burners that are fired with a liquid or a gaseous fuel which is burned with the aid of a gas that contains at least 85 percent by volume oxygen and at most 10 percent by volume nitrogen.

2. A method according to claim 1, wherein the fuel is burned with a gas that contains at least 90 percent by volume oxygen.

3. A method according to claim 1, wherein the gas contains at least one noble gas in addition to oxygen and nitrogen.

4. A method according to claim 1, including the step of cooling the articles to a temperature at which the articles can be treated in an electrolyte bath, and thereafter subjecting the articles to an electrolyte.

5. A method according to claim 1, wherein during the heating step the articles are heated in the oven to a surface temperature of at most 1300 degrees C.

6. A method according to claim 1, wherein during the heating step the articles are heated in the oven for a time period of 0.1 to 300 minutes.

7. A method according to claim 1, wherein the fuel is essentially propane.

8. A method according to claim 1, including the step of cooling the heated articles in an atmosphere containing a gas selected from the group consisting of nitrogen, argon, and hydrogen and mixtures thereof.

9. A method according to claim 1, wherein the fuel is burned with a gas that contains at least 99.5 percent oxygen, by volume.

10. A method according to claim 1, including the step of cooling the articles to a temperature at which the articles can be treated in an acid bath, and thereafter subjecting the articles to an acid bath.

11. A method for heat-treating a stainless steel article to minimize surface oxide scale formation, said method comprising the steps of:

a. conveying a stainless steel article into a heat treatment oven;

b. burning within the oven a liquid or gaseous fuel to heat the article within the oven to a surface temperature above about 900 degrees C.; and c. introducing into the burning fuel a gas that contains at least 85 percent by volume oxygen and at most 10 percent by volume nitrogen for reducing surface scale thickness on the heated article.

12. A method according to claim 11, wherein the surface temperature of the steel article during heating is from about 900° C. to about 1500° C.

13. A method in accordance with claim 11, including the step of cooling the heated steel article to a temperature of from about 70° C. to about 500° C.

14. A method according to claim 13, including the step of subjecting the cooled article to an acid bath for removing surface scale from the article.

15. A method according to claim 13, including the step of subjecting the cooled article to an electrolyte bath for removing surface scale from the article.

* * * * *